US006667607B2

(12) United States Patent
Kawamura et al.

(10) Patent No.: US 6,667,607 B2
(45) Date of Patent: Dec. 23, 2003

(54) POWER SUPPLY CIRCUIT FOR CLAMPING EXCESSIVE INPUT VOLTAGE AT PREDETERMINED VOLTAGE

(75) Inventors: Hiroshi Kawamura, Kasugai (JP); Hidenobu Ito, Kasugai (JP); Katsuya Shimizu, Kasugai (JP); Hiroto Nakamichi, Kagoshima (JP)

(73) Assignee: Fujitsu Limited, Kawasaki (JP)

( * ) Notice: Subject to any disclaimer, the term of this patent is extended or adjusted under 35 U.S.C. 154(b) by 18 days.

(21) Appl. No.: 10/107,390

(22) Filed: Mar. 28, 2002

(65) Prior Publication Data

US 2003/0042882 A1 Mar. 6, 2003

(30) Foreign Application Priority Data

Aug. 31, 2001 (JP) ..... 2001-263490

(51) Int. Cl.[7] ..... G05F 3/04
(52) U.S. Cl. ..... 323/312; 323/315
(58) Field of Search ..... 323/299, 303, 323/312, 313, 314, 315

(56) References Cited

U.S. PATENT DOCUMENTS

| | | | | | |
|---|---|---|---|---|---|
| 4,567,381 | A | * | 1/1986 | Piasecki | 327/542 |
| 4,885,484 | A | * | 12/1989 | Gray | 327/325 |
| 5,465,190 | A | * | 11/1995 | Meunier et al. | 361/91.5 |
| 5,530,340 | A | * | 6/1996 | Hayakawa et al. | 323/314 |
| 6,078,204 | A | * | 6/2000 | Cooper et al. | 327/309 |
| 6,222,355 | B1 | * | 4/2001 | Ohshima et al. | 323/282 |
| 6,222,709 | B1 | * | 4/2001 | Baba | 361/18 |

* cited by examiner

*Primary Examiner*—Adolf D. Berhane

(57) ABSTRACT

A power supply circuit that withstands voltages greater than or equal to a voltage capacity and prevents an increase in circuit area and manufacturing costs. The power supply circuit includes a first transistor for receiving a DC voltage and generating an internal power supply voltage. A clamp circuit is connected to the first transistor. The clamp circuit is activated when the DC current voltage is an excessive voltage to clamp the internal power supply voltage at a predetermined voltage that is less than the excessive voltage. A gate voltage control circuit is connected to the first transistor and the clamp circuit to supply the gate of the transistor with a control voltage so that the internal power supply voltage decreases when the clamp circuit is activated.

12 Claims, 3 Drawing Sheets

POWER SUPPLY CIRCUIT FOR CLAMPING EXCESSIVE INPUT VOLTAGE AT PREDETERMINED VOLTAGE

BACKGROUND OF THE INVENTION

The present invention relates to a power supply circuit, and more particularly, to a power supply circuit used in a charger for portable electronic equipment or the like.

In the prior art, the voltage capacity of devices that configure an internal circuit of an IC chip, which is used in, for example, a charger for electronic portable equipment, is determined by the maximum rating voltage. The IC chip is manufactured in accordance with a manufacturing process that corresponds to the voltage capacity of the devices.

Generally, when a device having a high voltage capacity is used in an IC chip, the area occupied by the device increases. This increases the chip area and causes the manufacturing process to be complicated. Accordingly, the employment of devices having a high voltage capacity increases costs.

When a power supply voltage greater than or equal to the maximum rating voltage is applied to a power supply IC chip, the power supply voltage may damage devices. Thus, devices that have a large voltage capacity must be used to withstand a power supply voltage that is greater than or equal to the maximum rating voltage. However, when the internal devices have a high voltage capacity, the chip area increases, which increases the manufacturing cost.

SUMMARY OF THE INVENTION

It is an objective of the present invention to provide a power supply circuit that withstands voltages greater than or equal to the voltage capacity and prevents the circuit area from increasing without increasing manufacturing cost.

To achieve the above objective, the present invention provides a power supply circuit including a first transistor for receiving a DC voltage and generating an internal power supply voltage. A clamp circuit is connected to the first transistor. The clamp circuit is activated when the DC current voltage is an excessive voltage to clamp the internal power supply voltage at a predetermined voltage that is less than the excessive voltage. A gate voltage control circuit is connected to the first transistor and the clamp circuit for supplying a gate of the transistor with a control voltage so that the internal power supply voltage decreases when the clamp circuit is activated.

A further perspective of the present invention is a power supply circuit including a p-channel MOS transistor. A first diode, a zener diode, and a first NPN transistor are connected in series between the p-channel MOS transistor and a predetermined power supply. A second NPN transistor has a base connected to a base of the first NPN transistor. A current mirror circuit is connected to the second NPN transistor and the p-channel MOS transistor.

A further perspective of the present invention is a semiconductor device including a power supply circuit. The power supply circuit includes a first transistor for receiving a DC voltage and generating an internal power supply voltage. A clamp circuit is connected to the first transistor. The clamp circuit is activated when the DC current voltage is an excessive voltage and clamps the internal power supply voltage at a predetermined voltage that is less than the excessive voltage. A gate voltage control circuit is connected to the first transistor and the clamp circuit to supply a gate of the transistor with a control voltage so that the internal power supply voltage decreases when the clamp circuit is activated.

A further perspective of the present invention is a semiconductor device including a power supply circuit. The power supply circuit includes a p-channel MOS transistor. A first diode, a zener diode, and a first NPN transistor are connected in series between the p-channel MOS transistor and a predetermined power supply. A second NPN transistor has a base connected to a base of the first NPN transistor. A current mirror circuit is connected to the second NPN transistor and the p-channel MOS transistor.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
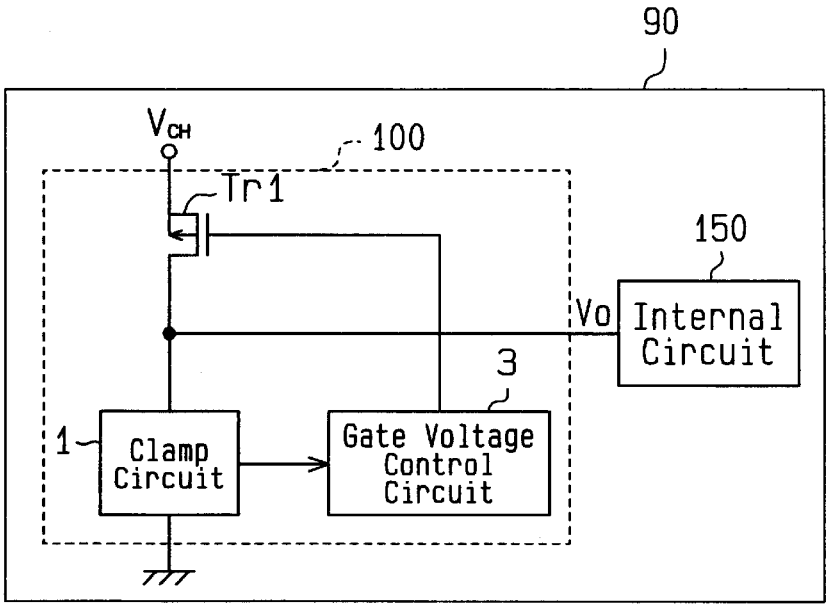
FIG. 1 is a schematic block diagram of a power supply circuit according to a first embodiment of the present invention.

In the drawings, like numerals are used for like elements throughout.

Referring to FIG. 1, a power supply circuit 100 according to a first embodiment of the present invention is connected to an internal circuit 150 in a semiconductor device 90. The power supply circuit 100 includes a transistor Tr1, a clamp circuit 1 connected between the transistor Tr1 and the ground, and a gate voltage control circuit 3 connected between the clamp circuit 1 and the gate of the transistor Tr1.

The transistor Tr1 receives a DC voltage VCH and generates an internal power supply voltage Vo, which is supplied to the internal circuit 150. The clamp circuit 1 is activated when the internal power supply voltage Vo, which is substantially equal to the DC voltage VCH, is an excessive voltage. The gate voltage control circuit 3 controls the gate voltage of the transistor Tr1 so that the internal power supply voltage Vo decreases in response to the activation of the clamp circuit 1. Further, the gate voltage control circuit 3 controls and maintains the gate voltage of the transistor Tr1 at a predetermined clamp voltage regardless of fluctuations in the excessive voltage.

Figure 2:
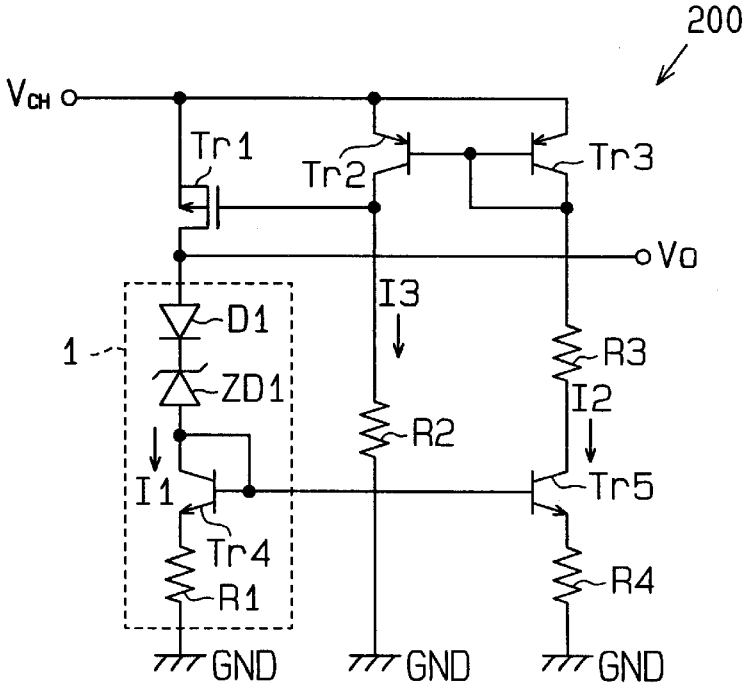
FIG. 2 is a schematic circuit diagram of a power supply circuit according to a second embodiment of the present invention.

With reference to FIG. 2, a power supply circuit 200 according to a second embodiment of the present invention supplies power supply voltage to a charging circuit (not shown), which charges a battery of a cellular phone or the like. That is, the power supply circuit 200 receives the DC voltage VCH and supplies the charging circuit with the internal power supply voltage Vo.

The DC voltage VCH is supplied to the source of a p-channel MOS transistor Tr1 and the emitters of PNP transistors Tr2 and Tr3, which configure a current mirror circuit. The drain of the transistor Tr1 is connected to the anode of a diode D1. The cathode of the diode D1 is connected to the cathode of a zener diode ZD1.

The anode of the zener diode ZD1 is connected to the collector and base of an NPN transistor Tr4. The emitter of the transistor Tr4 is connected to the ground GND via a resistor R1. The diode D1, the zener diode ZD1, the transistor tr4, and the resistor R1 configure a clamp circuit 1.

The bases of the transistors Tr2, Tr3 are connected to each other and to the collector of the transistor Tr3. The gate of the transistor Tr1 is connected to the collector of the transistor Tr2 and to the ground GND via a resistor R2.

The collector of the transistor tr3 is connected to the collector of an NPN transistor Tr5 via a resistor R3. The emitter of the transistor Tr5 is connected to the ground GND via a resistor R4.

The base of the transistor Tr5 is connected to the base of the transistor Tr4. The transistors Tr4, Tr5 configure a current mirror circuit. The internal power supply voltage Vo is generated at the drain of the transistor Tr1. The transistors Tr2, Tr3, Tr5 and the resistors R2–R4 configure a gate voltage control circuit.

The operation of the power supply circuit 200 will now be discussed.

For example, when the supplied DC voltage VCH is 5.5V (normal voltage), the gate potential at the transistor Tr1 decreases to the ground GND level and activates the transistor Tr1. This applies a voltage to the zener diode ZD1 that is decreased from the DC voltage VCH by an amount equal to the decreased voltage in the forward direction of the diode D1. However, at this voltage, the zener diode ZD1 is not conductive. Accordingly, the transistors Tr4, Tr5 do not go on, and the transistors Tr2, Tr3 do not function. As a result, an internal power supply voltage Vo that is less than the DC voltage VCH by the threshold value of the transistor Tr1 is generated at the drain of the transistor Tr1.

When the DC voltage VCH is an excessive voltage, the excessive voltage is applied to the zener diode ZD1 via the transistor Tr1 and the diode D1. As a result, the zener diode ZD1 becomes conductive and simultaneously activates the transistor Tr4 and the transistor Tr5. The activation of the transistor Tr5 simultaneously activates the transistor Tr3 and the transistor Tr2. As a result, a collector current I3 of the transistor Tr2 flows through the resistor R2. This increases the gate potential at the transistor Tr1 and decreases the drain current of the transistor Tr1.

In this state, the collector current I1 of the transistor Tr4 increases as the DC voltage VCH increases. This increases the collector current I2 of the transistors Tr5, Tr3. As the current I2 increases, the collector current I3 of the transistor Tr2 increases. This increases the gate voltage at the transistor Tr1.

As the DC voltage VCH decreases, the collector current I1 of the transistor Tr4 decreases. This decreases the collector current I2 of the transistors Tr5, Tr3. As the current I2 decreases, the collector current I3 of the transistor Tr2 decreases. This decreases the gate voltage at the transistor Tr1.

In such manner, when an excessive voltage is supplied, the internal power supply voltage Vo is clamped at a predetermined voltage in correspondence with the current set by the current mirror circuits and maintained at the fixed clamp voltage regardless of fluctuations in the excessive voltage.

The source/drain voltage of the transistor Tr1 is the potential difference between the DC voltage VCH and the internal power supply voltage Vo. Thus, the source/drain voltage remains less than or equal to the voltage capacity between the source and drain of the transistor Tr1. Further, the resistor R2 keeps the source/gate voltage of the transistor Tr1 less than or equal to the voltage capacity between the source and gate. In addition, the resistor R3 keeps the collector/emitter voltage of the transistor Tr5 less than or equal to the voltage capacity between the collector and emitter.

The power supply circuit 200 of the second embodiment has the advantages described below.

(1) When the supplied voltage VCH is a normal voltage, an internal power supply voltage Vo that is substantially the same as the DC voltage VCH is generated.

(2) When the supplied voltage VCH is an excessive voltage, the excessive voltage is decreased to the predetermined clamp voltage to generate a decreased internal power supply voltage Vo.

(3) Even when an excessive voltage is supplied, the internal power voltage Vo is not generated as an excessive voltage. Further, the devices of the power supply circuit 200 are prevented from being damaged by an excessive voltage. Accordingly, an IC chip provided with the power supply circuit 200 and an internal circuit does not have to have a high voltage capacity. This prevents an increase in the chip area and the manufacturing cost.

(4) The power supply circuit 200 is provided with a clamping function by adding a simple configuration that includes the transistor Tr1, the clamp circuit 1, and the current mirror circuits.

Figure 3:
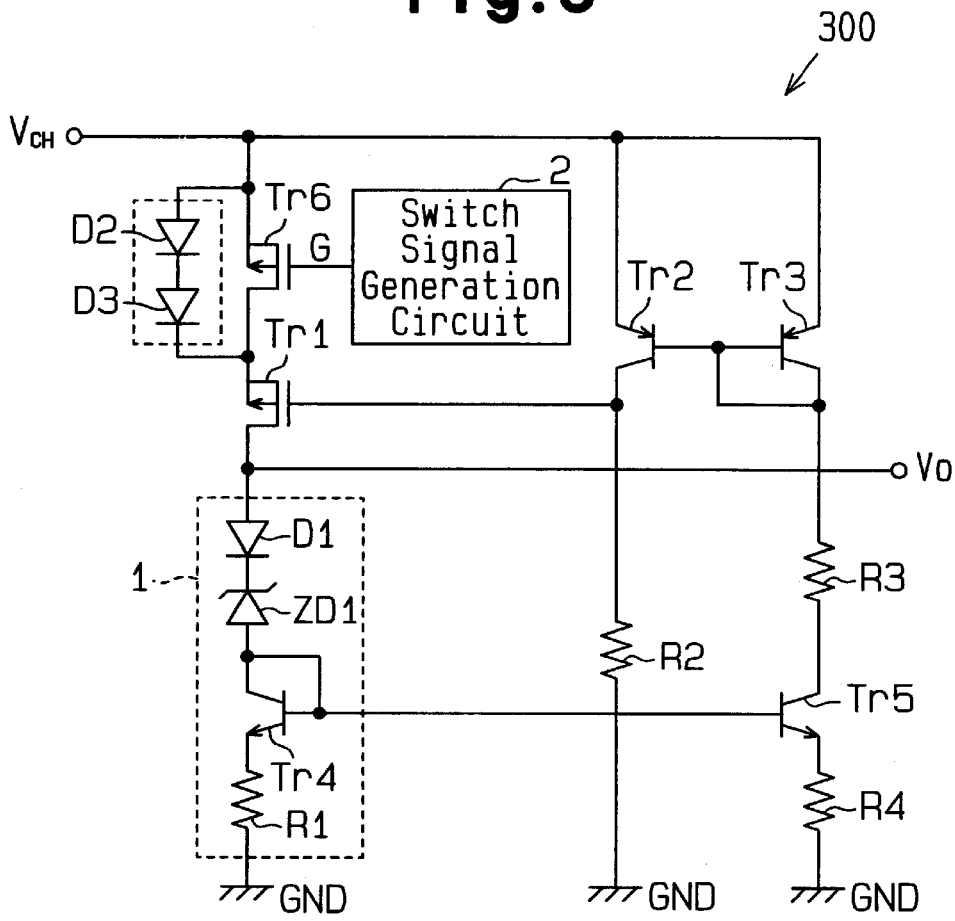
FIG. 3 is a schematic circuit diagram of a power supply circuit according to a third embodiment of the present invention.

With reference to FIG. 3, a power supply circuit 300 according to a third embodiment of the present invention includes a p-channel MOS transistor (switch circuit) Tr6, step-down diodes D2, D3, and a switch signal generation circuit 2 in addition to the power supply circuit 200 of FIG. 2.

The transistor Tr6 is connected between the DC voltage VCH and the source of the transistor Tr1. Series-connected diodes D2, D3 are connected between and in parallel to the source and drain of the transistor Tr6.

Figure 4:
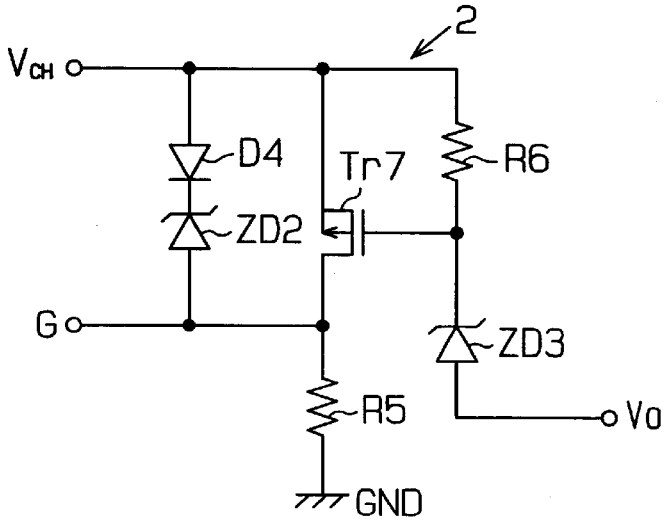
FIG. 4 is a schematic circuit diagram of a switch signal generation circuit of the power supply circuit of FIG. 3.

FIG. 4 is a schematic circuit diagram of the switch signal generation circuit 2. The DC voltage VCH is supplied to the source of a p-channel MOS transistor Tr7. The drain of the transistor Tr7 is connected to the ground GND via a resistor R5. A control signal G is provided from a drain of the transistor Tr7 to the gate of the transistor Tr6.

The DC voltage VCH is also supplied to the anode of a diode D4. The cathode of the diode D4 is connected to the cathode of a zener diode ZD2. The anode of the zener diode ZD2 is connected to the drain of the transistor Tr7.

Further, the DC voltage VCH is supplied to the gate of the transistor Tr7 via a resistor R6. The gate of the transistor Tr7 is connected to the cathode of a zener diode ZD3. The anode of the zener diode ZD3 is connected to the internal power supply voltage Vo.

When the DC voltage VCH is a normal voltage, the zener diodes ZD2, ZD3 of the switch signal generation circuit 2 are not conductive and the transistor Tr7 is inactivated. This causes the control signal to fall to the ground GND level and activates the transistor Tr6. In this state, the DC voltage VCH is supplied to the source of the transistor Tr1 via the transistor Tr6.

When the DC voltage VCH is an excessive voltage, the zener diodes ZD2, ZD3 become conductive and the resistor R6 decreases the voltage to activate the transistor Tr7. This increases the voltage of the control signal G to a value that is substantially equal to the DC current voltage VCH and inactivates the transistor Tr6. The diode D4 and the zener diode ZD2 function to set the minimum voltage of the control signal G at a value decreased from the DC voltage VCH by an amount equal to the step-down voltage in the forward direction of the diode D4. When the transistor Tr6 is inactivated, the DC voltage VCH is supplied to the source of the transistor Tr1 via the diodes D2, D3.

The power supply circuit 300 of the third embodiment has the advantages discussed below.

When the DC voltage VCH is an excessive voltage, a voltage that is decreased from the DC voltage VCH by an amount equal to the step-down voltage in the forward direction of the diodes D2, D3 is applied to source of the transistor Tr1. Accordingly, even if a larger DC voltage VCH is supplied, the predetermined internal power supply voltage Vo is supplied while preventing the devices from being damaged by an excessive voltage.

Figure 5:
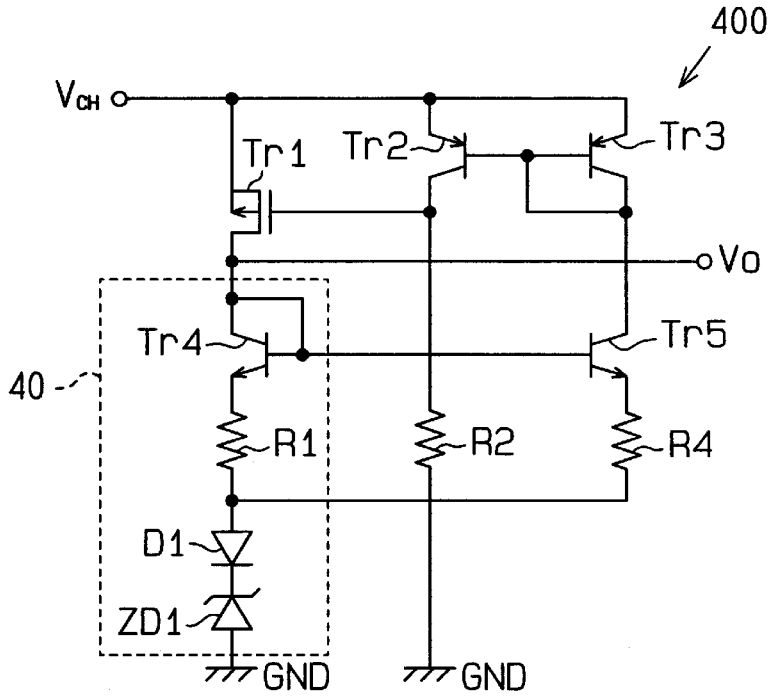
FIG. 5 is a schematic circuit diagram of a power supply circuit according to a fourth embodiment of the present invention.

With reference to FIG. 5, a power supply circuit 400 according to a fourth embodiment of the present invention has a clamp circuit 40, which differs from the clamp circuit 1 of the second embodiment. In the clamp circuit 40, the diode D1 and the zener diode ZD1 are connected between the resistor R1 and the ground GND. The anode of the diode D1 is connected to the emitter of the transistor Tr5 via a resistor R4. The power supply circuit 400 of the fourth embodiment does not have the resistor R3.

When the DC voltage VCH is a normal voltage, the zener diode ZD1 is not conductive. Thus, the transistors Tr2–Tr5 do not function, thereby generating an internal power supply voltage Vo that is substantially the same as the DC voltage VCH.

When the DC voltage VCH is an excessive voltage, the zener diode ZD1 becomes conductive and activates the transistors Tr2–Tr5. This clamps the current voltage VCH at a predetermined voltage and outputs the clamped voltage as the internal power supply voltage Vo. In this state, the resistor R4 is connected to the anode of the diode D1. Thus, the emitter potential at the transistor Tr5 is greater than the emitter potential in the second and third embodiments.

The power supply circuit 400 of the fourth embodiment has the advantages described below.

The anode of the diode D1 is connected to the resistor R4. Thus, the emitter potential at the transistor Tr5 is greater than the emitter potential at the transistor Tr5 of the second embodiment. Accordingly, the collector/emitter voltage of the transistor Tr5 is maintained at a value that is less than or equal to the voltage capacity of devices even though the resistor R3 used in the power supply circuit 200 of the second embodiment is eliminated.

A power supply circuit 500 according to a fifth embodiment of the present invention will now be discussed with reference to FIG. 6. The power supply circuit 500 includes a clamp circuit 50, which differs from the clamp circuit 40 of the fourth embodiment. The clamp circuit 50 includes a diode D5 connected between a drain of the transistor Tr1 and the collector of the transistor Tr4. The clamp circuit 50 does not have a diode D1 between the resistor R1 and the zener diode ZD1.

In the fifth embodiment, the transistor Tr5 is prevented from being saturated when the current mirror circuits of the transistors Tr2–Tr5 start to operate. In other words, the diode D5 applies an emitter potential, which is less than the collector potential by an amount equal to the step-down voltage in the forward direction of the diode D5, when the current mirror circuits configured by the transistors Tr2–Tr5 start to function. This prevents the transistor Tr5 from being saturated, increases the operating speed of the current mirror circuits, and quickly stabilizes the internal power supply voltage Vo. In the fourth embodiment, when the current mirror circuits configured by the transistors Tr2–Tr5 start to function, a collector potential, which is less than the DC voltage VCH by an amount equal to the step-down voltage VBE between the base and emitter of the transistor Tr2 or Tr3, is applied at the collector of the transistor Tr5. Further, a voltage that is substantially equal to the DC voltage VCH is applied to the base of the transistor Tr5. As a result, the collector potential and the emitter potential at the transistor Tr5 are substantially equalized. This saturates the transistor Tr5, delays the operation of the transistor Tr2 and the increase speed of the gate potential at the transistor Tr1.

It should be apparent to those skilled in the art that the present invention may be embodied in many other specific forms without departing from the spirit or scope of the invention. Particularly, it should be understood that the present invention may be embodied in the following forms.

The number of the diodes D1 of FIGS. 2 and 3 used to adjust the clamp voltage may be changed as required.

The number of the diodes D2, D3 of FIG. 3 used to adjust the DC voltage, which is supplied to the source of the transistor Tr1, may be changed as required.

Figure 6:
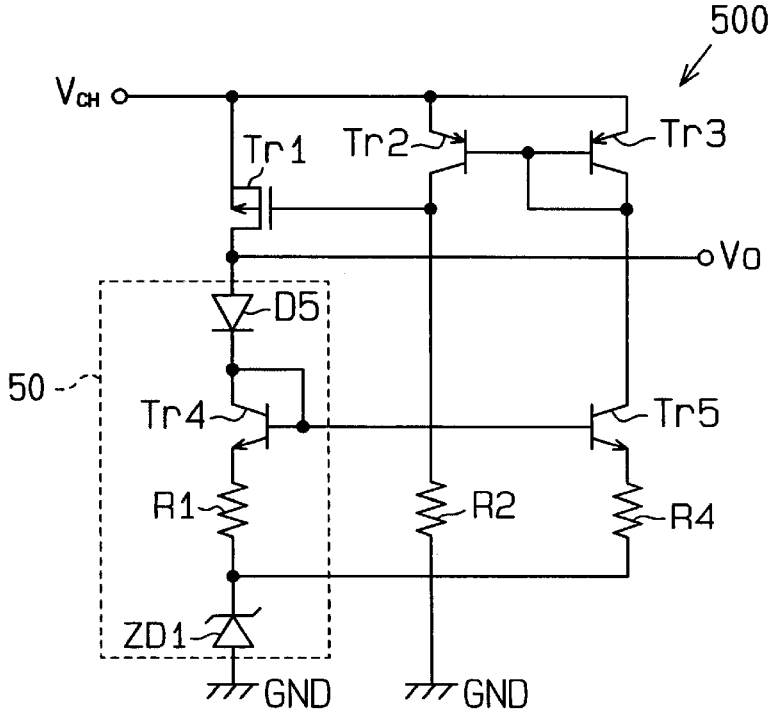
FIG. 6 is a schematic circuit diagram of a power supply circuit according to a fifth embodiment of the present invention.

The number of the diode D5 of FIG. 6 that is used to adjust the potential of the base of the transistor Tr5 may be changed as required.

The diodes and zener diodes used in each embodiment may be replaced by other devices.

The bipolar transistor of the current mirror circuit may be replaced by a FET.

In each of the above embodiments, the current ratio of the current mirror circuit is set at 1:1. However, the current ratio may be changed as required.

The transistor tr1 may be replaced by a bipolar transistor.

The present examples and embodiments are to be considered as illustrative and not restrictive, and the invention is not to be limited to the details given herein, but may be modified within the scope and equivalence of the appended claims.

What is claimed is:

1. A power supply circuit comprising:

a first transistor for receiving a DC voltage and generating an internal power supply voltage;

a clamp circuit connected to the first transistor, wherein the clamp circuit is activated when the DC voltage is an excessive voltage to clamp the internal power supply voltage at a predetermined voltage that is less than the excessive voltage; and a gate voltage control circuit connected to the first transistor and the clamp circuit for supplying a gate of the transistor with a control voltage so that the internal power supply voltage decreases when the clamp circuit is activated.

2. The power supply circuit according to claim 1, wherein the first transistor is a p-channel MOS transistor including a source, which is connected to the DC voltage, and a drain, where the internal power supply voltage is generated, wherein the clamp circuit includes:

a zener diode that is conductive when the internal power supply voltage at the drain of the p-channel MOS transistor is an excessive voltage; and a second transistor activated when the zener diode is conductive; and wherein the gate voltage control circuit includes a current mirror circuit connected to the second transistor for increasing the gate potential of the p-channel MOS transistor when the second transistor is activated.

3. The power supply circuit according to claim 1, wherein the clamp circuit includes:

a first diode connected to the first transistor;

a zener diode connected to the first diode; and a first NPN transistor connected to the zener diode;

wherein the current mirror circuit includes:

a second NPN transistor having a base connected to a base of the first NPN transistor; and a pair of PNP transistors functioning as a current mirror with respect to a current flowing a collector of the second NPN transistor.

4. The power supply circuit according to claim 1, further comprising:

a step-down diode connected between the first transistor and the DC voltage; and a switch circuit connected in parallel to the step-down diode for short-circuiting the step-down diode when the DC voltage is a normal voltage.

5. The power supply circuit according to claim 1, wherein the clamp circuit includes:

a first NPN transistor connected to the first transistor;

a first diode connected to an emitter of the first NPN transistor; and a zener diode connected to the first diode;

wherein the current mirror circuit includes;

a second NPN transistor having a base connected to a base of the first NPN transistor and an emitter connected to the zener diode; and a pair of PNP transistors functioning as a current mirror with respect to a current flowing a collector of the second NPN transistor.

6. The power supply circuit according to claim 1, wherein the clamp circuit includes:

a first diode connected to the first transistor;

a first NPN transistor connected to the first diode; and a zener diode connected to an emitter of the first NPN transistor;

wherein the current mirror circuit includes:

a second NPN transistor having a base connected to a base of the first NPN transistor and an emitter connected to the zener diode; and a pair of PNP transistors functioning as a current mirror with respect to a current flowing a collector of the second NPN transistor.

7. A power supply circuit comprising:

a p-channel MOS transistor;

a first diode, a zener diode, and a first NPN transistor connected in series between the p-channel MOS transistor and a predetermined power supply;

a second NPN transistor having a base connected to a base of the first NPN transistor; and a current mirror circuit connected to the second NPN transistor and the p-channel MOS transistor.

8. The power supply circuit according to claim 7, further comprising:

a step-down diode connected between a p-channel MOS transistor and a DC voltage; and a switch circuit connected in parallel to the step-down diode for short-circuiting the step-down diode when the DC voltage is a normal voltage.

9. The power supply circuit according to claim 7, wherein the first NPN transistor is connected to the p-channel MOS transistor, and the zener diode is connected to emitters of the first and second NPN transistors via the first diode.

10. The power supply circuit according to claim 7, wherein the first NPN transistor is connected to the p-channel MOS transistor via the first diode, and the zener diode is connected to emitters of the first and second NPN transistors.

11. A semiconductor device including a power supply circuit, the power supply circuit comprising:

a first transistor for receiving a DC voltage and generating an internal power supply voltage;

a clamp circuit connected to the first transistor, wherein the clamp circuit is activated when the DC voltage is an excessive voltage and clamps the internal power supply voltage at a predetermined voltage that is less than the excessive voltage; and a gate voltage control circuit connected to the first transistor and the clamp circuit for supplying a gate of the transistor with a control voltage so that the internal power supply voltage decreases when the clamp circuit is activated.

12. A semiconductor device including a power supply circuit, the power supply circuit comprising:

a p-channel MOS transistor;

a first diode, a zener diode, and a first NPN transistor connected in series between the p-channel MOS transistor and a predetermined power supply;

a second NPN transistor having a base connected to a base of the first NPN transistor; and a current mirror circuit connected to the second NPN transistor and the p-channel MOS transistor.

* * * * *